US011373798B2

(12) United States Patent
Nakamura et al.

(10) Patent No.: US 11,373,798 B2
(45) Date of Patent: Jun. 28, 2022

(54) IGNITION DEVICE

(71) Applicant: Walbro LLC, Tucson, AZ (US)

(72) Inventors: Shunya Nakamura, Iwanuma (JP); Yuki Tanaka, Natori (JP); Kazunori Tsubakino, Iwanuma (JP)

(73) Assignee: Walbro LLC, Cass City, MI (US)

( * ) Notice: Subject to any disclaimer, the term of this patent is extended or adjusted under 35 U.S.C. 154(b) by 413 days.

(21) Appl. No.: 16/612,442

(22) PCT Filed: May 11, 2018

(86) PCT No.: PCT/US2018/032204
§ 371 (c)(1),
(2) Date: Nov. 11, 2019

(87) PCT Pub. No.: WO2018/209171
PCT Pub. Date: Nov. 15, 2018

(65) Prior Publication Data

US 2020/0203063 A1 Jun. 25, 2020

(30) Foreign Application Priority Data

May 12, 2017 (JP) ..... JP2017-095139

(51) Int. Cl.
*H01F 27/24* (2006.01)
*H01F 27/32* (2006.01)
(Continued)

(52) U.S. Cl.
CPC ..... *H01F 27/327* (2013.01); *F02P 1/005* (2013.01); *F02P 3/02* (2013.01); *H01F 27/02* (2013.01);
(Continued)

(58) Field of Classification Search
CPC ..... H01F 27/327; H01F 27/02; H01F 27/24; H01F 27/28; H01F 27/325; H01F 38/12;
(Continued)

(56) References Cited

U.S. PATENT DOCUMENTS 6,337,616 B1 * 1/2002 Sato ..... H01F 38/12 336/96
6,650,219 B1 * 11/2003 Widiger ..... H01F 27/022 336/198
(Continued)

FOREIGN PATENT DOCUMENTS

JP S6068626 U 5/1985
JP 2007165421 A 6/2007
(Continued)

OTHER PUBLICATIONS

Written Opinion & International Search Report for PCT/US2018/032204 dated Sep. 18, 2018, 9 pages.

*Primary Examiner* — Tuyen T Nguyen
(74) *Attorney, Agent, or Firm* — Reising Ethington P.C.; Matthew J. Schmidt

(57) ABSTRACT

An ignition device includes a case having an opening and a bottom wall, a coil bobbin arranged in the case having a through hole, a first end and a second end, an ignition coil wound around the coil bobbin, a core made of magnetic material and projecting from the opening and from the bottom wall, and extending through the coil bobbin, a retainer having a ring portion and multiple leg portions extending from the ring, and a filling resin in the case. The core extends through the ring portion and the leg portions extend in between an inner surface of the coil bobbin and an outer peripheral surface of the core toward the bottom wall, and the case is filled with the filling resin in a manner that at least a part of the ring portion is not covered by the resin.

17 Claims, 6 Drawing Sheets

(51) Int. Cl.

| | |
|---|---|
| ***F02P 1/00*** | (2006.01) |
| ***F02P 3/02*** | (2006.01) |
| ***H01F 27/02*** | (2006.01) |
| ***H01F 27/28*** | (2006.01) |
| ***H01F 38/12*** | (2006.01) |
| *F02P 1/02* | (2006.01) |
| *H01F 27/26* | (2006.01) |

(52) U.S. Cl.
CPC ..... *H01F 27/24* (2013.01); *H01F 27/28* (2013.01); *H01F 27/325* (2013.01); *H01F 38/12* (2013.01); *F02P 1/02* (2013.01); *H01F 27/263* (2013.01); *H01F 27/266* (2013.01); *H01F 27/32* (2013.01); *H01F 27/324* (2013.01)

(58) Field of Classification Search
CPC .. H01F 2038/122; H01F 27/022; H01F 27/26; H01F 27/32; F02P 1/005; F02P 3/02; F02P 1/02; F02P 15/00; F02P 1/083
See application file for complete search history.

(56) References Cited

U.S. PATENT DOCUMENTS

| | | | | |
|---|---|---|---|---|
| 6,930,583 | B2 * | 8/2005 | Kawai ..... | H01F 27/327 336/198 |
| 2009/0194084 | A1 | 8/2009 | Kojima et al. | |
| 2013/0291844 | A1 | 11/2013 | Skinner et al. | |

FOREIGN PATENT DOCUMENTS

| | | | |
|---|---|---|---|
| JP | 2009170538 | A | 7/2009 |
| JP | 2016092218 | A | 5/2016 |
| KR | 101425484 | B1 | 8/2014 |
| KR | 101573545 | B1 | 12/2015 |

* cited by examiner

15

151
152

151
152
151
151a,151a-1

151b
151
152

151
152
151b
151d
151c 152a
151
151c
152
152a
151a,151a-1
152a
152

IGNITION DEVICE

REFERENCE TO RELATED APPLICATIONS

This application claims the benefit of Japanese Application Serial No. 2017-095139 filed on May 12, 2017 the entire contents of which are incorporated herein by reference in its entirety.

TECHNICAL FIELD

The present disclosure relates to an ignition device for generating high voltage for an ignition event in an internal combustion.

BACKGROUND

Conventionally, an ignition device in which a core and an ignition coil are housed in a resin case is known. The resin case may be filled with a filling resin, and a part of the core arranged within the resin case, the ignition coil, and the like are covered by the resin. The core made of laminated iron cores and the like often includes a rectangular columnar portion. This columnar portion of the core was positioned within the resin case, and the filling resin was provided between the columnar portion and an inner wall face of the resin case. In this case, stress may be concentrated in a part of the filling resin contacting the core due to a difference in coefficient of thermal expansion between the core and the filling resin, and the filling resin may crack.

SUMMARY

At least some implementations of an ignition device include a case having an opening and a bottom wall opposite to the opening, a coil bobbin arranged in the case having a through hole, a first end and a second end with the first end closer to the opening than the second end, an ignition coil wound around the coil bobbin, a core made of magnetic material and projecting from the opening and from the bottom wall, and the core extends through the coil bobbin, a retainer having a ring portion and multiple leg portions extending from the ring, and a filling resin in the case. The ring portion is arranged adjacent to the first end of the coil bobbin, and the core extends through the ring portion, wherein the leg portions extend in between an inner surface of the through hole of the coil bobbin and an outer peripheral surface of the core toward the bottom wall along the center core. The case is filled with the filling resin in a manner that at least a part of the ring portion opposite to the leg portions is not covered by the resin.

In at least some implementations, the core is formed in a polygonal column shape, and wherein each of the leg portions of the retainer extends along each corner of the core. The polygonal column shape may be a rectangular column shape, and the leg portions of the retainer may include four leg portions each of which extends along each of four corners of the core. The core may penetrate the ring portion, while an inner peripheral border of the ring portion extends along the core, and wherein each of the leg portions extends from the inner peripheral border along the core. And in at least some implementations, the retainer is made of nylon.

In at least some implementations, an ignition device includes a resin case having an opening, a core made of magnetic material, and having a columnar portion, of which one end projects from the opening, and of which other end penetrates and projects from a bottom wall of the resin case opposite to the opening, a coil bobbin which the columnar portion penetrates, and arranged in an interior of the resin case, an ignition coil wound around the coil bobbin, a retainer of which a ring portion and a plurality of leg portions extending from the ring portion are integrally molded with resin, the ring portion defining an opening that is complementary in shape to the periphery of columnar portion, and a filling resin with which the resin case is filled. The ring portion is arranged in an end of the coil bobbin at the opening side, while the columnar portion extends through the opening of the ring portion. The plurality of leg portions extends in between an inner face of a through hole of the coil bobbin and an outer peripheral face of the columnar portion toward the bottom wall along the columnar portion. And the resin case is filled with the filling resin in a manner that at least a part of the ring portion opposite to the plurality of leg portions is exposed.

According to at least some implementations of the ignition device, the plurality of leg portions defines a position between the core and the coil bobbin, and then defines a position between the core and the resin case. Further, on a surface of the filling resin in the resin case at the opening side, the core penetrates the ring portion of the retainer. Because the ring portion is round (e.g. circular or oval) it has no corners, and high stresses associated with such corners are not concentrated in the filling resin adjacent an outer periphery of the ring portion, and as a result, cracks are not generated in the filling resin.

Here, in the ignition device of at least some implementations of the present disclosure, the columnar portion may be formed in a polygonal column shape, and each of the plurality of leg portions of the retainer extends along each corner of the columnar portion. In some implementations, each of the plurality of leg portions extending along each corner of the columnar portion can define a position between the columnar portion of the core and the coil bobbin with high accuracy. Further, in at least some implementations, the polygonal column shape may be a rectangular column shape, and the plurality of leg portions of the retainer may be four leg portions each of which extends along each of four corners of the columnar portion. In this ignition device, by providing the leg portions each of which may extend along each of four corners of the columnar portion, the position can be defined stably and with high accuracy.

Further, in at least some implementations of the ignition device, the columnar portion penetrates the ring portion, while an inner peripheral border of the ring portion extends along the columnar portion, and each of the plurality of leg portions extends from the inner peripheral border along the columnar portion. In at some implementations of the ignition device, a positional relationship between the ring portion of the retainer and the columnar portion can be maintained throughout a length of the leg portion. Thereby, the position can be defined with high accuracy.

Further, the retainer may be made of nylon. A retainer made of nylon may be effective in a case that the core is made of iron as a counter-measure against an alkali attacking due to rust of the core. Namely, corrosion resistance against alkali is improved.

DETAILED DESCRIPTION

Figure 1:
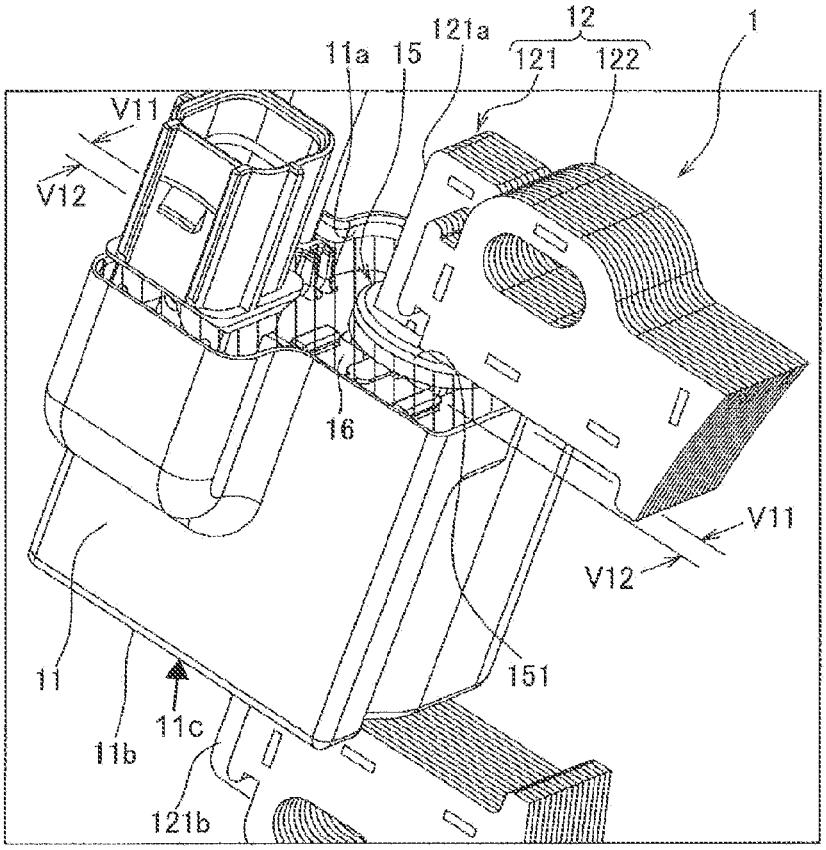
FIG. 1 is a perspective view showing an embodiment of an ignition device according to the present disclosure.

Hereinafter, an embodiment of an ignition device according to the present disclosure will be described. An ignition device 1 according to this embodiment is a device for an internal combustion, and includes: a resin case 11; a core 12; a coil bobbin 13; an ignition coil 14; a retainer 15; and a filling resin 16. This ignition device 1 generates an ignition high voltage by using an induced electromotive force generated in the ignition coil 14, such as by the movement of magnets relative to the coil, where the magnets are sometimes carried on a flywheel of the engine.

The case 11 may be made of PBT (Poly Butylene Terephthalate) or other suitable material and has an opening or open end 11*a*. The core 12 includes: a center core 121; and at least one side yoke 122. Both the center core 121 and the side yoke 122 are laminated iron cores made of iron as magnetic material, and may be integrally formed on the same pieces of material rather than separately formed components that are connected together after formation. The center core 121 may be a rectangular columnar portion and one end 121*a* of the center core 121 may project from the opening 11*a*, and the other end 121*b* may penetrate and project from a bottom wall 11*b* of the resin case 11 opposite to the opening 11*a*, such as through an opposite opening 11*c* in the bottom wall 11*b*. Two side yokes are shown, and the side yokes 122 are respectively connected to the one end 121*a* and the other end 121*b* of the center core 121, and have free ends located outside of the case 11.

The coil bobbin 13 may be housed in the resin case 11 in a manner that the coil bobbin 13 may extend vertically from or somewhat near the bottom wall 11*b* to the opening 11*a* of the resin case 11. In this regard, the coil bobbin 13 may have a first end 13*b* that is closer to the opening 11*a* than the bottom wall 11*b* and a second end 13*c* that is closer to the bottom wall 11*b* than the opening 11*a*. The center core 121 penetrates or extends through a center through hole 13*a* of the coil bobbin 13. The ignition coil 14 may include a conductive wire that is wound around an outer periphery of this coil bobbin 13.

Figure 4:
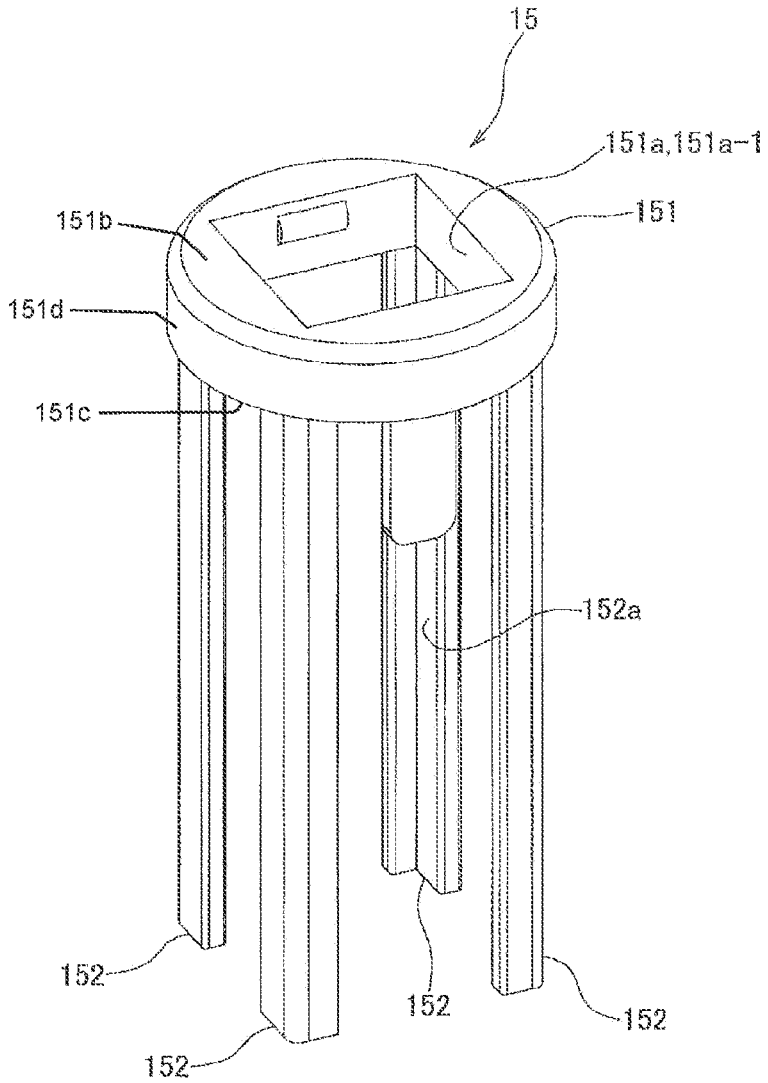
FIG. 4 is an enlarged perspective view of a retainer.
Figures 5A, 5B, 5C, 5D, 5E, 5F:
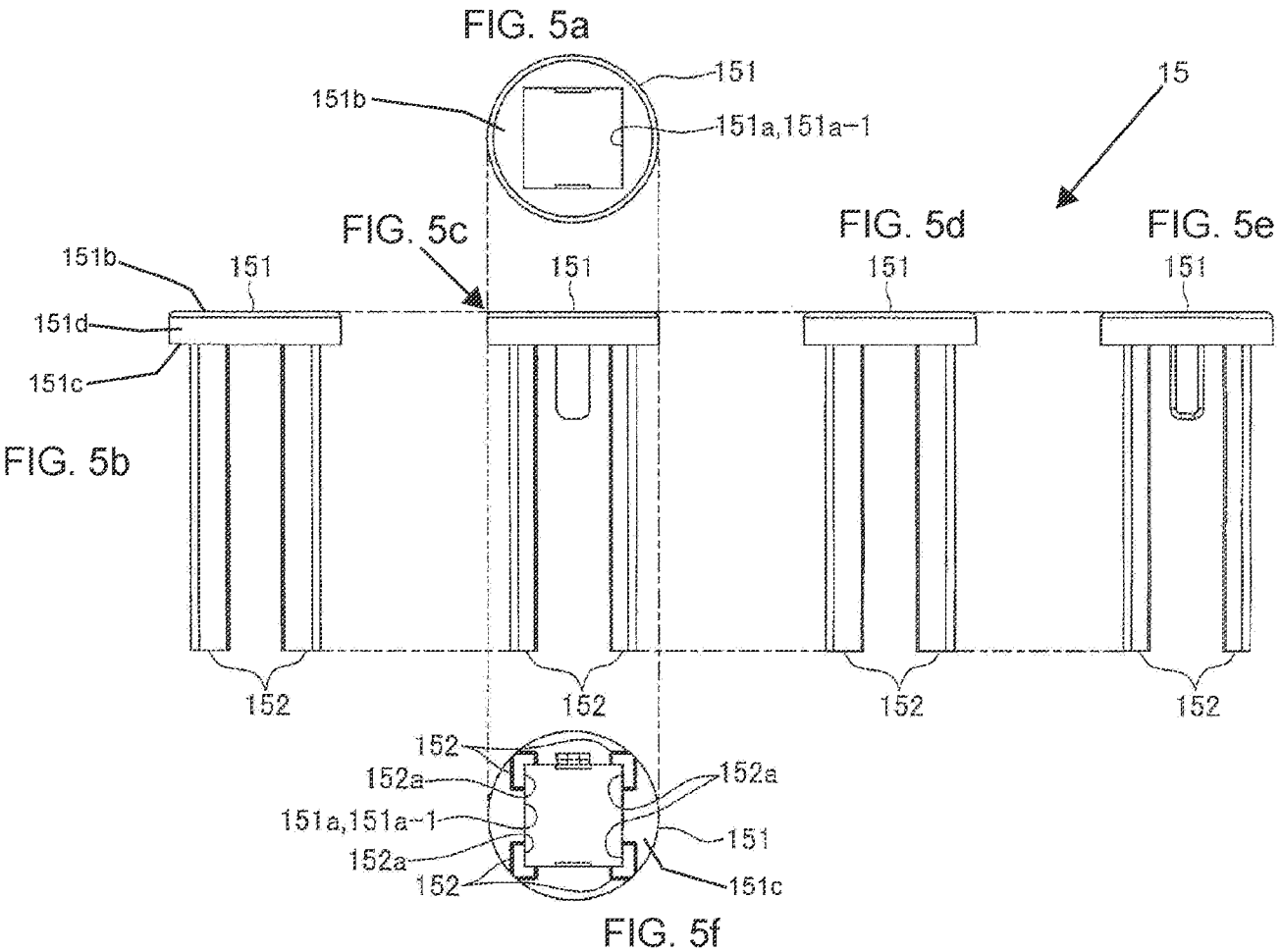
FIGS. 5*a*-5*f* are top, left side, front, right side, rear and bottom views, respectively, of the retainer shown in FIG. 4.
Figures 6A, 6B, 6C, 6D, 6E, 6F:
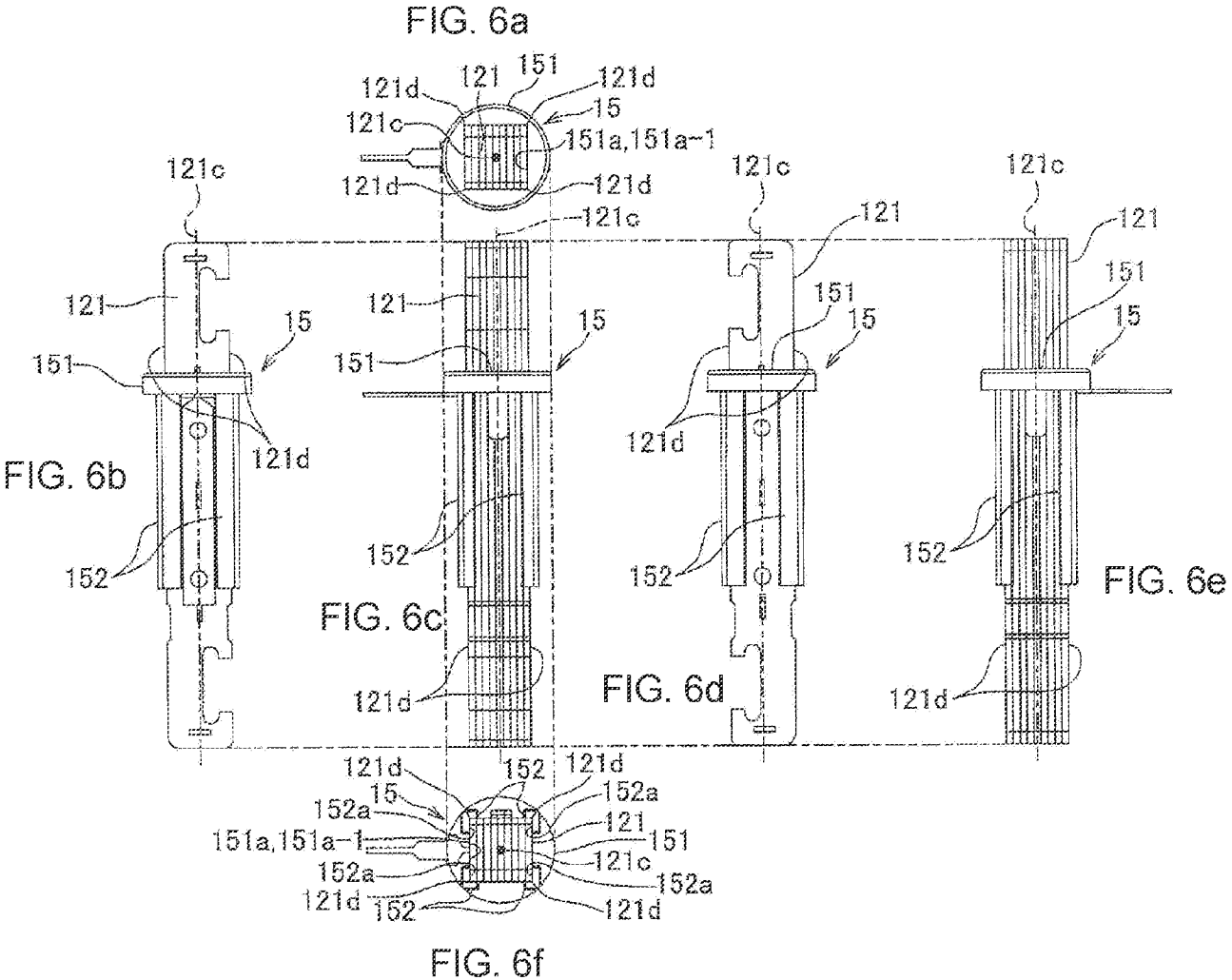
FIGS. 6*a*-6*f* are top, left side, front, right side, rear and bottom views, respectively, of the retainer of which ring portion is penetrated by a center core.

The retainer 15 may be made by integral molding of a ring portion 151, which may be circular or oval in shape, and four leg portions 152 so that each of these features, in at least some implementations, are formed in the same piece of material and are formed at the same time (i.e. when the retainer is molded). The ring portion 15 may include a first surface 151*b* (FIGS. 2, 4, 5*a* and 5*b*) that faces outwardly relative to the opening 11*a* (e.g. away from the opening or away from the bottom wall 11*b* and a second surface 151*c* (FIGS. 4, 5*b* and 5*f*) that is opposite to the first surface 151*b* relative to a central axis 121*c* (FIGS. 6*a*-6*f*) of the center core 121. The first surface 151*b* and/or second surface 151*c* may be planar, and may further be perpendicular to the central axis 121*c*, if desired. As described later in detail, in this retainer 15, the four leg portions 152 may define a position between the center core 121 and the coil bobbin 13, and then define a position between the center core 121 and the resin case 11. That is, the retainer 15 may help to locate the core 12 relative to the bobbin 13 and perhaps also relative to the case 11.

Further, the filling resin 16 may be an epoxy resin injected and filled via the opening 11*a* of the resin case 11. The resin case 11 is filled with the filling resin 16 in a manner that some of the ring portion 151 opposite to the four leg portions 152 of the retainer 15 is exposed in a thickness direction. That is, the ring portion is not, in at least some implementations, fully covered by the resin 16 but has at least a portion, which may include the first surface 151*b*, that is exposed or extends out of the resin 16. In at least some implementations, the ring portion 151 may be considered to be partially embedded within the resin 16. Further, the filling resin 16 may enter spaces between the four leg portions 152, and the spaces may be filled with the filling resin 16.

Figure 2:
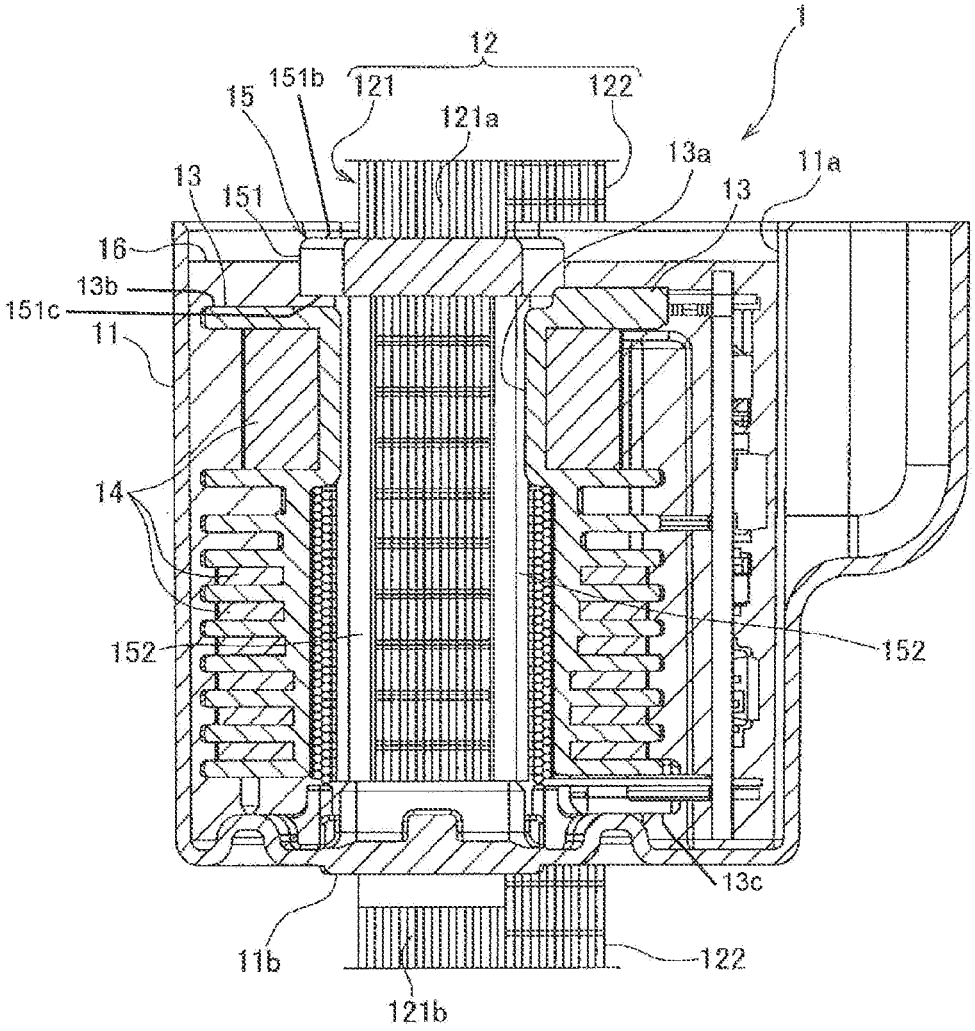
FIG. 2 is a sectional view taken on line V11-V11 in FIG. 1.
Figure 3:
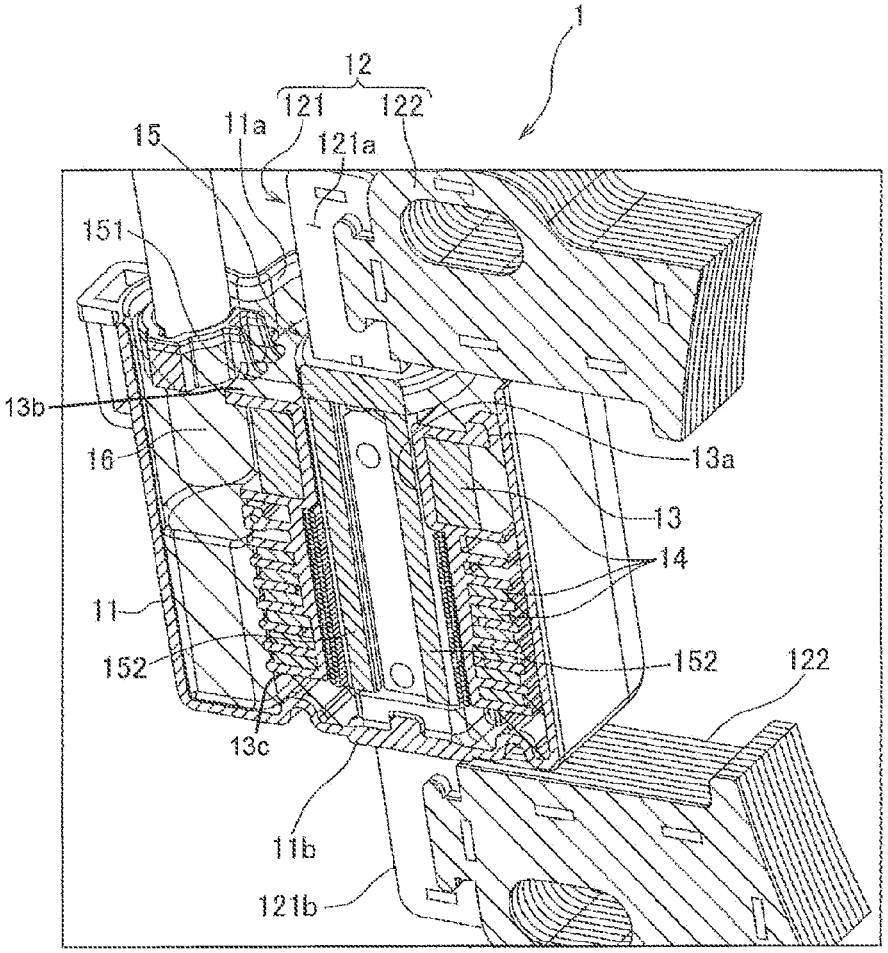
FIG. 3 is a sectional view taken on line V12-V12 in FIG. 1.

The ring portion 151 may have a rectangular through hole 151*a* of which shape may be substantially the same as a cross-section of the center core 121 perpendicular to the center axis 121*c*. In assembly, the center core 121 is fitted into this through hole 151*a* and the center core 121 extends through the ring portion 151, while an inner peripheral border 151*a*-1 extends along part of the center core 121. Then, as shown in FIGS. 2 and 3, the ring portion 151 is arranged at an end of the opening 11*a* side of the coil bobbin, while penetrated by the center core 121 as described above. That is, the ring portion 151 may be arranged closer to the first end 13*b* of the coil bobbin 13 than the second end 13*c*, and the leg portions 152 may extend from the ring portion 151 toward the second end 13*c* of the coil bobbin 13.

Each of the four leg portions 152 may extend in between an inner surface of the through hole 13*a* of the coil bobbin 13 and an outer peripheral surface of the center core 121 toward the bottom wall 11*b* of the resin case 11 along the center core 121. Here, in this embodiment, the four leg portions 152 may extend along the four corners 121*d*, and the leg portions 152 may face each other with the center axis 121*c* therebetween. Further, each of the four leg portions 152 may extend from the inner peripheral border 151*a*-1 of the ring portion 151 along the center core 121. Each leg portion may be generally L-shaped, having a rectangular groove 152*a* formed at a center core 121 side of each leg portion 152 for fitting the corner 121*d* of the center core 121 therein. An inner surface of the leg portions 152, which is received against the center core 121, may be concave (may be deemed concave even if defined by linear and not curved segments) as viewed from the center axis 121*c*, and may be aligned with and contiguous with the corners of the opening 151*a* which may be received directly adjacent to the center core 121, and mated over the corners 121*d* of the center core 121.

According to the ignition device 1 of this embodiment as described above, the core 12 is partially housed in the resin case 11, the four leg portions 152 define the position between the core 12 and the coil bobbin 13, and thereby define the position between the core 12 and the resin case 11. Further, on a surface of the filling resin 16 in the resin case 11 at the opening 11*a* side, the core 12 penetrates the ring portion 151 of the retainer 15. Because a radially outer surface or periphery 151*d* (FIGS. 4 and 5*b*) of the ring portion 151, which extends between the first and second surfaces 151*b*, 151*c*, is rounded and has no corner, there is no sharp angled portion or corner (e.g. a junction between adjacent linear or flat portions) at which higher stresses may develop in the filling resin 16 adjacent to the outer periphery 151*d* of the ring portion 151, and as a result, cracks are prevented from being generated in the filling resin 16.

Further, the upper surface 151*b* also is not covered by the filling resin 16, in at least some implementations which can further reduce the likelihood that cracks will form in the resin. In at least some implementations, the outer surface 151*d* may extend generally axially, that is, parallel to the axis 121*c* and perpendicular to the first and second surfaces 151*b*, 151 *c* when they are perpendicular to the axis 121*c*, such as in the implementation shown in the drawings. This provides a disc-shaped ring portion 151 that has a round periphery and a thickness in the axial direction that is defined between the first and second surfaces 151*b*, 151*c*.

Further, in the ignition device 1 of this embodiment, the center core 121 is formed in a rectangular column shape as a polygonal column shape, and each one of the four leg portions 152 of the retainer 15 extends along a respective one of four corners of the center core 121. By providing the four leg portions 152 which extend along each of four corners 121*d* in the rectangular column shape of the center core 121, the position of the center core 121 of the core 12 can be defined stably and with high accuracy. Further, the legs may be tightly received such as a line to line or press-fit between the center core 121 and the coil bobbin 13, or there may be limited play between the components which are more firmly held when the resin 16 is added.

Further, in the ignition device 1 of this embodiment, the retainer 15 may be made of nylon. The retainer 15 made of nylon resin is effective as a counter-measure against an alkali attacking due to rust of the core 12 made of laminated iron cores (in particular, the center core 121). Namely, according to the ignition device 1 of this embodiment, corrosion resistance property against alkali can be improved.

Further, in the ignition device 1 of this embodiment, the center core 121 penetrates or extends through the ring portion 151, while the inner peripheral border 151*a*-1 of the ring portion 151 extends along the center core 121, and each of the four leg portions 152 extends from this inner peripheral border 151*a*-1 along the center core 121. Thereby, a positional relationship between the ring portion 151 of the retainer 15 and the center core 121 can be maintained throughout a length of the leg portions 152, and the position between the ring portion 151 of the retainer 15 and the center core 121 can be defined with high accuracy.

The embodiment described above is only one embodiment, and the present invention is not limited to this embodiment. Namely, the ignition device described above can be modified without departing from the scope of the present invention. For example, in the above embodiment the retainer 15 has four leg portions 152 extending along the four corners 121*d* of the rectangular columnar center core 12 as an example of the columnar portion is exemplified. However, the retainer of the present invention is not limited to this. For example, the retainer 15 of the present invention may be provided with two leg portions extending along a pair of corners facing each other of the four corners of the rectangular columnar portion. Alternatively, in addition to these two leg portions, one leg portion may be added and extend along one of the remaining corners, and total three leg portions may be provided. Alternatively, the leg portions may not extend along the corners of the columnar portion, but may extend along a side face between the corners. In this way, in the retainer of the present invention, the specific number of the leg portions and the arrangement of the leg portions may be properly set as desired.

Further, in the above embodiment, the retainer has the through hole 151*a* through which the center core 121 extends or is received, while the inner peripheral border 151*a*-1 of the ring portion 151 extends along the rectangular columnar center core 121. Further, in this retainer 15, each of the four leg portions 152 extends from the inner peripheral border 151*a*-1 along the center core 121. However, the retainer of the present invention is not limited to this. In the retainer of the present invention, a through hole larger than the cross section of the columnar portion and different from the cross-sectional shape may be provided on the ring portion. Further, the leg portions may extend along the columnar portion from positions away from the inner peripheral border of the through hole of the ring portion.

Further, in the above embodiment, as an example of the columnar portion of the present invention, the rectangular columnar center core 121 is shown. However, the columnar portion of the present invention is not limited to this, and may be in a polygonal column shape, such as triangular column, or pentagonal column other than rectangular column. Alternatively, the columnar portion of the present invention may be in a round bar or cylindrical shape. In these cases, a plurality of leg portions of the retainer may be provided along each corner, side faces, or a periphery of the round bar or cylinder for positioning stably the columnar portion having these shapes.

Further, in the above embodiment, the resin case 11 is described as being made of PBT and the retainer 15 is described as being made of nylon. Further, the filling resin 16 is described as being an epoxy resin. However, the resin case, the retainer, and the filling resin of the present invention are not limited to these, and can be selected properly from a wider range of materials. However, as described above, by using the retainer made of nylon resin, the corrosion resistance property against alkali can be improved.

Further, in the above embodiment, as an example of the core of the present invention, the core 12 is described as being made of laminated iron cores and having the center core 121 and the side yokes 122. However, the core of the present invention is not limited to this, and may be made of magnetic material other than the laminated iron cores. Further, the core of the present invention may be formed integrally with the magnetic material other than a separate configuration as described above. And the shape of the core may be different than shown and described, for example, may include a third yoke 122 between the side yokes 122 shown, providing a generally E-shaped core. Of course, other core shapes may be used.

What is claimed is:

1. An ignition device, comprising:

a case having an opening and a bottom wall opposite to the opening;

a coil bobbin arranged in the case having a through hole, a first end and a second end with the first end closer to the opening than the second end;

an ignition coil wound around the coil bobbin;

a core made of magnetic material and projecting from the opening and from the bottom wall, and the core extends through the coil bobbin;

a retainer having a ring portion and multiple leg portions extending from the ring; and a filling resin in the case, wherein the ring portion is arranged adjacent to the first end of the coil bobbin, and the core extends through the ring portion, wherein the leg portions extend in between an inner surface of the through hole of the coil bobbin and an outer peripheral surface of the core toward the bottom wall along the center core, and wherein the case is filled with the filling resin in a manner that at least a part of the ring portion opposite to the leg portions is not covered by the resin.

2. The ignition device of claim 1, wherein the core is formed in a polygonal column shape, and wherein the leg portions of the retainer each extend along a respective one of the corners of the core.

3. The ignition device of claim 2, wherein the polygonal column shape is a rectangular column shape, and wherein the leg portions of the retainer include four leg portions that each extend along a respective one of the corners of the core.

4. The ignition device of claim 1, wherein the core penetrates the ring portion, while an inner peripheral border of the ring portion extends along the core, and wherein each of the leg portions extends from the inner peripheral border along the core.

5. The ignition device of claim 2, wherein the core penetrates the ring portion, while an inner peripheral border of the ring portion extends along the core, and wherein each of the leg portions extends from the inner peripheral border along the core.

6. The ignition device of claim 3, wherein the core penetrates the ring portion, while an inner peripheral border of the ring portion extends along the core, and wherein each of the leg portions extends from the inner peripheral border along the core.

7. The ignition device of claim 1, wherein the retainer is made of nylon.

8. The ignition device of claim 2, wherein the retainer is made of nylon.

9. The ignition device of claim 1, wherein the ring portion has a radially outer periphery that is round and does not have a corner.

10. The ignition device of claim 9, wherein the ring portion has a first surface that faces outwardly away from the opening of the case and a second surface that is opposite to the first surface, and wherein the first surface is not covered by the filling resin.

11. The ignition device of claim 10, wherein the ring portion includes a radially outer surface between the first surface and second surface, and the radially outer surface is round.

12. The ignition device of claim 2, wherein the ring portion includes an opening complimentary in shape to the core and having corners, and wherein each leg portion is aligned with a respective one of the corners of the opening.

13. An ignition device, comprising:

a resin case having an opening;

a core made of magnetic material, and having a columnar portion, of which one end projects from the opening, and of which other end penetrates and projects from a bottom wall of the resin case opposite to the opening;

a coil bobbin which the columnar portion penetrates, and arranged in an interior of the resin case;

an ignition coil wound around the coil bobbin;

a retainer of which a ring portion and a plurality of leg portions extending from the ring portion are integrally molded with resin, the ring portion defining an opening that is complementary in shape to the periphery of columnar portion; and a filling resin with which the resin case is filled, wherein the ring portion is arranged in an end of the coil bobbin at the opening side, while the columnar portion extends through the opening of the ring portion, wherein the plurality of leg portions extends in between an inner face of a through hole of the coil bobbin and an outer peripheral face of the columnar portion toward the bottom wall along the columnar portion, and wherein the resin case is filled with the filling resin in a manner that at least a part of the ring portion opposite to the plurality of leg portions is exposed.

14. The ignition device of claim 13, wherein the ring portion has a radially outer periphery that is round and does not have a corner.

15. The ignition device of claim 14, wherein the ring portion has a first surface that faces outwardly away from the opening of the case and a second surface that is opposite to the first surface, and wherein the first surface is not covered by the filling resin.

16. The ignition device of claim 15, wherein the ring portion includes a radially outer surface between the first surface and second surface, and the radially outer surface is round.

17. The ignition device of claim 13, wherein the ring portion includes an opening complimentary in shape to the core and having corners, and wherein each leg portion is aligned with a respective one of the corners of the opening.

* * * * *